US009216840B2

(12) United States Patent
Metzger et al.

(10) Patent No.: US 9,216,840 B2
(45) Date of Patent: Dec. 22, 2015

(54) VACUUM CONTAINER WITH PROTECTIVE FEATURES

(75) Inventors: Elizabeth A. Metzger, Milwaukee, WI (US); Thomas J. Clyde, Milwaukee, WI (US); Thomas S. Diss, Waukesha, WI (US); Kamchat Soisuvarn, Saugus, CA (US)

(73) Assignee: Silgan Containers LLC, Woodland Hills, CA (US)

( * ) Notice: Subject to any disclaimer, the term of this patent is extended or adjusted under 35 U.S.C. 154(b) by 49 days.

(21) Appl. No.: 13/398,644

(22) Filed: Feb. 16, 2012

(65) Prior Publication Data

US 2012/0145584 A1 Jun. 14, 2012

Related U.S. Application Data

(63) Continuation of application No. 12/098,300, filed on Apr. 4, 2008, now Pat. No. 8,141,741, which is a continuation-in-part of application No. 12/040,609, filed on Feb. 29, 2008, now abandoned, and a continuation-in-part of application No. 29/304,271, filed on Feb. 27, 2008, now Pat. No. Des. 588,018.

(51) Int. Cl.
*B65D 8/12* (2006.01)
*B65D 8/00* (2006.01)
(Continued)

(52) U.S. Cl.
CPC .. *B65D 7/04* (2013.01); *B65D 7/46* (2013.01); *B65D 17/08* (2013.01); *B65D 17/163* (2013.01); *B65D 43/0212* (2013.01); *B65D 81/2015* (2013.01); *Y10S 220/906* (2013.01)

(58) Field of Classification Search
CPC ..... B65D 7/04; B65D 7/36; B65D 7/44
USPC ..... 220/670, 672, 675, 906, 907, 669; D9/776, 777; 215/382
See application file for complete search history.

(56) References Cited

U.S. PATENT DOCUMENTS

D2,820 S 11/1867 Barry
D22,751 S 8/1893 Lanning
(Continued)

FOREIGN PATENT DOCUMENTS

FR 2584680 1/1987
WO DM/046294 10/1998
WO DM/051799 3/2000

OTHER PUBLICATIONS

U.S. Appl. No. 29/332,322, filed Feb. 12, 2009, Diss.
(Continued)

*Primary Examiner* — Mickey Yu
*Assistant Examiner* — Niki Eloshway
(74) *Attorney, Agent, or Firm* — Reinhart Boerner Van Deuren s.c.

(57) ABSTRACT

A container including a metal sidewall is provided. The metal sidewall includes a first end; a second end; a center portion having a principal width; a first feature positioned between the center portion and the first end, the first feature extending from the sidewall such that the maximum width of the sidewall at the first feature is greater than the principal width; and a second feature positioned between the center portion and the second end, the second feature extending from the sidewall such that the maximum width of the sidewall at the second feature is greater than the principal width. The container further includes a first bead located in the center portion of the sidewall; and a second bead located in the center portion of the sidewall.

9 Claims, 4 Drawing Sheets

(51) Int. Cl.

| | |
|---|---|
| ***B65D 6/38*** | (2006.01) |
| ***B65D 17/00*** | (2006.01) |
| ***B65D 43/02*** | (2006.01) |
| ***B65D 81/20*** | (2006.01) |
| *B65D 8/08* | (2006.01) |

(56) References Cited

U.S. PATENT DOCUMENTS

| | | | |
|---|---|---|---|
| D24,991 | S | 12/1895 | Estes |
| D25,941 | S | 8/1896 | Lindgren |
| 566,067 | A | 8/1896 | Duck |
| D28,732 | S | 5/1898 | Cook |
| D28,842 | S | 6/1898 | Griffith |
| D38,167 | S | 8/1906 | Wintermann |
| 829,477 | A | 8/1906 | Kruse |
| 1,013,775 | A | 1/1912 | Hoffman |
| D56,181 | S | 8/1920 | Heinicke et al. |
| D67,869 | S | 7/1925 | Boswell |
| D73,511 | S | 9/1927 | Schrader |
| 1,706,638 | A | 3/1929 | Thomas |
| 1,773,278 | A | 8/1930 | Reid |
| 1,832,806 | A | 11/1931 | Dawson |
| D98,420 | S | 2/1936 | Deskey |
| D101,728 | S | 10/1936 | Bennett |
| 2,063,013 | A | 12/1936 | Cooper |
| 2,142,743 | A | 1/1939 | Calleson et al. |
| D120,226 | S | 4/1940 | Lundy |
| D120,587 | S | 5/1940 | Hinkins |
| D124,645 | S | 1/1941 | Palmer |
| D124,880 | S | 1/1941 | Teunisz |
| 2,252,915 | A | 8/1941 | Conill |
| D129,604 | S | 9/1941 | Forgue |
| 2,868,410 | A | 1/1959 | Henchert |
| D185,649 | S | 7/1959 | Schlumbohm |
| 3,170,590 | A | 2/1965 | Ullman et al. |
| D201,400 | S | 6/1965 | Elgin |
| 3,297,194 | A | 1/1967 | Schaper et al. |
| D207,133 | S | 3/1967 | Stenger |
| 3,317,110 | A | 5/1967 | Palmer |
| 3,349,987 | A | 10/1967 | Weitzner |
| D212,525 | S | 10/1968 | Kneapler |
| 3,448,891 | A | 6/1969 | Czarnecki |
| 3,648,884 | A | 3/1972 | Mansolino |
| D224,516 | S | 8/1972 | Amberg |
| D224,642 | S | 8/1972 | Mascia et al. |
| D226,176 | S | 1/1973 | Bystedt |
| D227,863 | S | 7/1973 | Mascia |
| D227,868 | S | 7/1973 | Stanley |
| D228,229 | S | 8/1973 | Mascia |
| D231,087 | S | 4/1974 | Edwards |
| D231,773 | S | 6/1974 | Mascia |
| D234,251 | S | 2/1975 | Edwards |
| D235,184 | S | 5/1975 | Achenbach |
| D237,853 | S | 12/1975 | Katz |
| 3,949,877 | A | 4/1976 | Santoni |
| 4,010,860 | A | 3/1977 | Garber |
| D249,111 | S | 8/1978 | Geyer |
| D252,798 | S | 9/1979 | Vosti et al. |
| 4,512,490 | A | 4/1985 | Frei et al. |
| D288,527 | S | 3/1987 | Maguire |
| D299,426 | S | 1/1989 | Andersson et al. |
| 4,804,105 | A | 2/1989 | Zysset et al. |
| 4,846,366 | A | 7/1989 | Satz |
| 4,880,131 | A | 11/1989 | Gallagher et al. |
| D307,238 | S | 4/1990 | May |
| 4,936,482 | A | 6/1990 | Gallagher et al. |
| 4,938,051 | A | 7/1990 | Duffy et al. |
| D317,405 | S | 6/1991 | Yasika |
| 5,040,698 | A | 8/1991 | Ramsey et al. |
| D319,580 | S | 9/1991 | Cassai et al. |
| D320,153 | S | 9/1991 | Cassai et al. |
| 5,052,573 | A | 10/1991 | Zysset |
| 5,065,888 | A | 11/1991 | Gallagher |
| D323,290 | S | 1/1992 | Keedy, Jr. |
| 5,103,995 | A | 4/1992 | Gallagher |
| D329,597 | S | 9/1992 | Gallagher et al. |
| 5,152,417 | A | 10/1992 | Gallagher |
| 5,240,138 | A | 8/1993 | Gallagher |
| D345,105 | S | 3/1994 | Ramsey |
| 5,316,169 | A | 5/1994 | Gallagher |
| D352,898 | S | 11/1994 | Vacher |
| D355,129 | S | 2/1995 | Gruodis |
| D355,368 | S | 2/1995 | Gruodis |
| D357,413 | S | 4/1995 | Kornick et al. |
| D357,414 | S | 4/1995 | Kornick et al. |
| D365,021 | S | 12/1995 | Park |
| D367,426 | S | 2/1996 | Ruff |
| D373,084 | S | 8/1996 | Choi |
| D378,572 | S | 3/1997 | Culverwell et al. |
| D379,589 | S | 6/1997 | Rhodes et al. |
| D381,259 | S | 7/1997 | Hayes |
| D383,037 | S | 9/1997 | Asberg |
| 5,711,448 | A | 1/1998 | Clarke, III |
| 5,720,412 | A | 2/1998 | Ficken |
| 5,722,561 | A | 3/1998 | Biondich et al. |
| 5,749,488 | A | 5/1998 | Bagwell et al. |
| D398,531 | S | 9/1998 | De Vries |
| D399,129 | S | 10/1998 | Ramsey |
| D399,425 | S | 10/1998 | Ramsey |
| D399,428 | S | 10/1998 | Ramsey |
| D399,429 | S | 10/1998 | Ramsey |
| D399,430 | S | 10/1998 | Ramsey |
| D399,753 | S | 10/1998 | Ramsey |
| D401,152 | S | 11/1998 | DeVore et al. |
| D403,962 | S | 1/1999 | Ramsey |
| D403,963 | S | 1/1999 | Ramsey |
| D404,254 | S | 1/1999 | Asberg |
| D404,970 | S | 2/1999 | Asberg |
| D406,065 | S | 2/1999 | Cheng |
| D406,236 | S | 3/1999 | Brifcani et al. |
| D408,221 | S | 4/1999 | Asberg |
| D409,496 | S | 5/1999 | Ramsey |
| D411,106 | S | 6/1999 | Conrad |
| D412,118 | S | 7/1999 | Rodea |
| D412,441 | S | 8/1999 | Cheng et al. |
| D413,519 | S | 9/1999 | Eberle et al. |
| 5,957,647 | A | 9/1999 | Hinton |
| D414,693 | S | 10/1999 | Cheng et al. |
| D416,200 | S | 11/1999 | Pavely et al. |
| 5,988,416 | A | 11/1999 | Cheng et al. |
| 5,988,417 | A | 11/1999 | Cheng et al. |
| D417,392 | S | 12/1999 | Zhang |
| D419,058 | S | 1/2000 | Roth et al. |
| D419,444 | S | 1/2000 | Zhang |
| 6,012,601 | A | 1/2000 | Van Dam |
| D419,886 | S | 2/2000 | Gans |
| D420,587 | S | 2/2000 | Cheng et al. |
| D421,393 | S | 3/2000 | Pavely et al. |
| D421,720 | S | 3/2000 | Eberle et al. |
| D421,907 | S | 3/2000 | Benge et al. |
| D423,336 | S | 4/2000 | Gray |
| D423,365 | S | 4/2000 | Eberle et al. |
| D425,424 | S | 5/2000 | Cheng et al. |
| 6,062,409 | A | 5/2000 | Eberle |
| D426,164 | S | 6/2000 | Gans et al. |
| D427,057 | S | 6/2000 | Roth et al. |
| D427,514 | S | 7/2000 | Roth et al. |
| D427,515 | S | 7/2000 | Roth et al. |
| D427,905 | S | 7/2000 | Eberle |
| 6,092,688 | A | 7/2000 | Eberle et al. |
| D429,151 | S | 8/2000 | Cheng et al. |
| D429,164 | S | 8/2000 | Peek et al. |
| 6,095,360 | A | 8/2000 | Shmagin et al. |
| 6,123,211 | A | 9/2000 | Rashid et al. |
| D431,465 | S | 10/2000 | Cheng et al. |
| D431,470 | S | 10/2000 | Henderson |
| D432,423 | S | 10/2000 | Rashid |
| D432,424 | S | 10/2000 | Andrew |
| 6,131,761 | A | 10/2000 | Cheng et al. |
| D435,455 | S | 12/2000 | Gans |
| 6,161,713 | A | 12/2000 | Krich |
| 6,164,474 | A | 12/2000 | Cheng et al. |
| 6,164,480 | A | 12/2000 | Heinicke et al. |
| D437,229 | S | 2/2001 | Andrew |

(56) References Cited

U.S. PATENT DOCUMENTS

D437,230 S 2/2001 Andrew
6,206,222 B1 3/2001 Cudzik
6,213,325 B1 4/2001 Cheng et al.
6,220,475 B1 4/2001 Nayar et al.
D441,295 S 5/2001 Krich
6,230,912 B1 5/2001 Rashid
D445,339 S 7/2001 Bazlur
D445,693 S 7/2001 Rashid
D445,694 S 7/2001 Gans
D446,455 S 8/2001 McGowan
D446,458 S 8/2001 Gans
D447,061 S 8/2001 Peek
6,280,679 B1 8/2001 Rashid et al.
D447,422 S 9/2001 Peek
D447,693 S 9/2001 Warner et al.
D448,302 S 9/2001 Cheng et al.
D448,303 S 9/2001 Cheng et al.
D448,304 S 9/2001 Cheng et al.
6,294,131 B1 9/2001 Jaffrey
D448,666 S 10/2001 Fields
D448,671 S 10/2001 Gans et al.
D448,672 S 10/2001 Cheng et al.
D448,675 S 10/2001 Thierjung
D448,677 S 10/2001 Krich
D449,539 S 10/2001 Lakatosh et al.
D449,993 S 11/2001 Schumann
D450,244 S 11/2001 Rashid
6,321,927 B2 11/2001 Cavella
D453,003 S 1/2002 Rashid
6,341,709 B1 1/2002 Wilson
6,347,717 B1 2/2002 Eberle
D454,073 S 3/2002 Crawford
6,354,458 B1 3/2002 Policappelli
D455,656 S 4/2002 Gans et al.
6,374,657 B1 4/2002 Kirk et al.
D456,712 S 5/2002 Krich
D457,435 S 5/2002 Rashid
6,398,052 B1 6/2002 Cheng et al.
6,419,874 B2 7/2002 Rashid et al.
D464,569 S 10/2002 Moore et al.
D465,158 S 11/2002 Peek et al.
D465,418 S 11/2002 Thierjung
D466,019 S 11/2002 Thierjung et al.
D466,021 S 11/2002 Thierjung et al.
D466,024 S 11/2002 Thierjung et al.
D466,813 S 12/2002 Thierjung et al.
D466,817 S 12/2002 Thierjung et al.
D469,360 S 1/2003 Moore et al.
6,575,684 B2 6/2003 Heinicke et al.
D476,889 S 7/2003 Fields
D476,896 S 7/2003 Cheng et al.
6,585,125 B1 7/2003 Peek
D478,286 S 8/2003 Futral et al.
D478,287 S 8/2003 Corker et al.
D479,999 S 9/2003 Moore
D480,650 S 10/2003 Moore et al.
D480,956 S 10/2003 Mooney et al.
D480,957 S 10/2003 Mooney et al.
D481,317 S 10/2003 Corker et al.
D484,808 S 1/2004 Thierjung et al.
D485,182 S 1/2004 Gaydon
6,685,417 B2 2/2004 Heinicke et al.
D489,983 S 5/2004 Futral et al.
D489,984 S 5/2004 Futral et al.
D491,288 S 6/2004 Young
D493,370 S 7/2004 Kamineni et al.
D494,475 S 8/2004 Thierjung et al.
6,769,561 B2 8/2004 Futral et al.
D498,143 S 11/2004 Rashid
6,877,607 B2 4/2005 Jenkins
6,889,862 B2 5/2005 Vaughan
D507,485 S 7/2005 Fields
D510,024 S 9/2005 Jacober et al.
D511,458 S 11/2005 Dunwoody et al.
D512,917 S 12/2005 Frisch et al.
D517,417 S 3/2006 Livingston et al.
D522,371 S 6/2006 Livingston
D523,341 S 6/2006 Livingston et al.
D523,347 S 6/2006 Livingston
D525,129 S 7/2006 Hutter et al.
D525,139 S 7/2006 Livingston et al.
D525,530 S 7/2006 Livingston et al.
7,108,469 B2 9/2006 Jenkins
7,112,771 B2 9/2006 Richardson et al.
D530,614 S 10/2006 Gatewood
D532,306 S 11/2006 MacLeod et al.
7,134,565 B1 11/2006 Wan et al.
D533,783 S 12/2006 Kliger et al.
D534,079 S 12/2006 Livingston
D534,428 S 1/2007 Reed et al.
D536,262 S 2/2007 Ioannides et al.
D536,263 S 2/2007 Ioannides et al.
D536,264 S 2/2007 Ioannides et al.
D538,645 S 3/2007 McDowell et al.
D538,646 S 3/2007 McDowell et al.
D538,660 S 3/2007 Gatewood
7,198,168 B2 4/2007 Mizuma
D542,130 S 5/2007 McDowell et al.
D542,650 S 5/2007 McDowell et al.
D543,845 S 6/2007 Ioannides et al.
D546,183 S 7/2007 Clutter
7,243,808 B2 7/2007 Livingston et al.
D549,596 S 8/2007 Ioannides et al.
D562,685 S 2/2008 Millspaw et al.
D588,016 S 3/2009 Ziegler
D588,017 S 3/2009 Ziegler et al.
D588,018 S 3/2009 Metzger et al.
D588,019 S 3/2009 Diss
D588,020 S 3/2009 Van Scoyoc et al.
D588,021 S 3/2009 Ziegler et al.
D588,936 S 3/2009 Ioannides et al.
D596,500 S 7/2009 Diss et al.
D596,501 S 7/2009 Diss et al.
D596,502 S 7/2009 Diss et al.
D596,503 S 7/2009 Diss
D596,504 S 7/2009 Diss
D596,505 S 7/2009 Diss et al.
D596,879 S 7/2009 Diss et al.
D596,881 S 7/2009 Diss et al.
D596,955 S 7/2009 Diss et al.
D596,956 S 7/2009 Diss et al.
D596,957 S 7/2009 Diss
D596,958 S 7/2009 Diss et al.
D606,402 S 12/2009 Diss
D606,403 S 12/2009 Diss
D606,404 S 12/2009 Diss
D606,405 S 12/2009 Takata et al.
D606,406 S 12/2009 Takata et al.
D607,329 S 1/2010 Diss
D607,727 S 1/2010 Takata et al.
D612,732 S 3/2010 Takata et al.
D614,049 S 4/2010 Diss et al.
D614,971 S 5/2010 Millspaw et al.
D620,377 S 7/2010 Diss
D649,887 S 12/2011 Diss
2001/0002671 A1 6/2001 Heinicke et al.
2001/0009107 A1 7/2001 Cheng et al.
2001/0009244 A1 7/2001 Cheng et al.
2002/0172578 A1 11/2002 Heinicke et al.
2005/0082299 A1 4/2005 Jenkins
2006/0108318 A1* 5/2006 Chisholm ..... 215/382
2006/0131257 A1 6/2006 Gatewood et al.
2006/0186082 A1 8/2006 Gatewood et al.
2007/0012648 A1 1/2007 Gatewood
2007/0045218 A1 3/2007 Afandyan
2007/0068943 A1 3/2007 Ramsey et al.
2007/0090120 A1 4/2007 Bezek
2007/0102425 A1 5/2007 Richardson et al.
2007/0108196 A1 5/2007 Richardson et al.
2007/0108197 A1 5/2007 Richardson et al.

(56) References Cited

U.S. PATENT DOCUMENTS

| | | | |
|---|---|---|---|
| 2007/0108198 | A1 | 5/2007 | Richardson et al. |
| 2007/0138181 | A1 | 6/2007 | Heinicke et al. |
| 2009/0218349 | A1 | 9/2009 | Metzger et al. |

OTHER PUBLICATIONS

U.S. Appl. No. 29/332,323, filed Feb. 12, 2009, Metzger et al.
U.S. Appl. No. 29/331,957, filed Feb. 5, 2009, Hu.
U.S. Appl. No. 29/332,328, filed Feb. 12, 2009, Metzger et al.
U.S. Appl. No. 29/312,033, filed May 12, 2008, Murphy et al.
"The Revolutionary Stretching Technology" brochure, believed to be available by 2001 at www.canstretch.com, 1 page.
"Stretch Machine" brochure, believed to be available by 2001 at www.canstretch.com, 1 page.
Photograph of Six Cans, believed to be available by 2001 at www.canstretch.com, 1 page.
Soudronic Image believed to be available by Apr. 24, 2007, 1 page.
Engineering Drawing of Cans developed by Assignee at least by Jul. 12, 2006, 1 page.
Photograph of Can developed by Assignee at least by Aug. 4, 2006, 1 page.

* cited by examiner

VACUUM CONTAINER WITH PROTECTIVE FEATURES

CROSS-REFERENCE TO RELATED PATENT APPLICATIONS

This application is a continuation of U.S. application Ser. No. 12/098,300, filed Apr. 4, 2008, which is a continuation-in-part of U.S. application Ser. No. 12/040,609, filed Feb. 29, 2008, and a continuation-in-part of U.S. Application No. 29/304,271, filed Feb. 27, 2008, which are incorporated herein by reference in their entireties.

BACKGROUND

The application generally relates to containers capable of maintaining a vacuum within the container after the container is sealed. The application relates more specifically to food containers capable of maintaining a vacuum with features to protect the integrity of the sealed container and/or to provide improved container structure.

Containers are used to store a variety of materials and objects. Some types of containers are used to store perishable material such as organic material, solid food, food having a liquid component, and liquids. These containers must often meet a variety of requirements depending on their intended use. For example, some containers must be able to withstand acidity of certain levels such that the container's intended contents do not compromise the container. Other containers must be able to successfully store liquid such that manipulation of the container during shipping and typical use do not cause the container to deform, break an airtight seal, and/or leak the container's contents. Yet other containers must be able to withstand food cooking processes involving the container. Some containers must meet all of the aforementioned requirements.

One type of food and beverage container is provided with a closure that is affixed to the container primarily by the pressure differential between external atmospheric pressure and a lower internal pressure. Other types of closures (e.g., twist on/off closures, snap on/twist off closures, etc.) are affixed to the container mechanically. Another type of food and beverage container is provided with a can end affixed to the container by folding or crimping the material of the can end to the container body. Containers that maintain a vacuum after the container is sealed are vulnerable to impacts during processing, labeling, and transport. Such impacts may break the hermetic vacuum seal of the container which may cause leakage and may expose contents of the container to spoilage.

In addition, food and beverage storage containers are subjected to a variety of forces during manufacture, filling and processing, sales, and transport. Containers must be strong enough to resist these forces without deformation. Further, containers with an internal vacuum must be strong enough to resist compressive deformation by the external atmospheric pressure. One solution is to make the container material thicker. However, this approach increases the container weight and the cost of raw materials.

Some containers are filled with hot, pre-cooked food then sealed for later consumption, commonly referred to as a "hot fill process." As the contents of the container cool, a vacuum develops inside the container. The resulting vacuum may partially or completely secure the closure to the body of the container. Foods packed with a hot fill process often have certain advantages. For example, end-users often appreciate pre-cooked food contents as preparation times are often shorter and more convenient.

Other containers are filled with uncooked food, the container is sealed, and the food is cooked to the point of being commercially sterilized or "shelf stable" while sealed within the container. This process is commonly called a thermal process. Also commonly, the required heat for the process is delivered by a pressurized device, or retort. Thermal processes also have certain advantages. First, the resulting shelf-stable package offers long-term storage of food in a hermetically sealed container. Second, cooking the food inside the container commercially sterilizes the food and the container at the same time.

Containers used with thermal processes often use can ends that require the use of a tool to open. For example, some containers suitable for use with thermal processes are metal cans having an end designed for use with a can-opener. Other containers suitable for use with thermal retort processes are containers having "pop-tops", "pull tops", convenience ends, or convenience lids having a tab or ring that aids in removal of the can end. Thermal retort processes present challenges to the design and manufacture of vacuum containing containers. For example, the pressure and temperature rigors of the thermal retort process may compromise the seal. In addition, differences in internal container pressure and external pressure during the thermal retort process may cause an unsecured vacuum sealable lid to separate from the container body.

Therefore, it would be desirable to provide a container capable of maintaining a vacuum having one or more protective features. Further, it would be desirable to provide a vacuumized container with protective features that is suitable for use with hot fill and/or thermal processes.

SUMMARY

One embodiment relates to a food or drink can including a metal sidewall. The metal sidewall includes a first end; a second end; and a center portion having a principal width. The metal sidewall further includes a first feature positioned between the center portion and the first end. The first feature extends from the sidewall such that the maximum width of the sidewall at the first feature is greater than the principal width. The metal sidewall further includes a second feature positioned between the center portion and the second end. The second feature extends from the sidewall such that the maximum width of the sidewall at the second feature is greater than the principal width. The food or drink can further includes a first bead located in the center portion of the sidewall and a second bead located in the center portion of the sidewall.

Another embodiment relates to a food or drink storage container including a metal body. The metal body includes a center portion having a principal width, a first end, a second end, and a midpoint. The metal body further includes a first feature that extends beyond the principal width, a second feature that extends beyond the principal width, a first body segment between the center portion and the first feature, and a second body segment between the center portion and the second feature. The metal body further includes a first bead positioned in the center portion of the body. The first bead is positioned between the midpoint and the first end of the center portion such that the distance from the midpoint to the first bead is greater than the distance from the first end to the first bead. The metal body includes a second bead positioned in the center portion of the body. The second bead is positioned between the midpoint and the second end of the center portion such that the distance from the midpoint to the second bead is greater than the distance from the second end to the second bead. The food or drink container further includes a container end coupled to the metal body. The center portion is located between the first feature and the second feature, and the first body segment and the second body segment are inwardly curved portions.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

DETAILED DESCRIPTION

Before turning to the figures which illustrate the exemplary embodiments in detail, it should be understood that the application is not limited to the details or methodology set forth in the following description or illustrated in the figures. It should also be understood that the terminology employed herein is for the purpose of description only and should not be regarded as limiting.

Referring generally to the figures, a container is shown having protective features integrally formed from the material of the container body. The container is provided with a container end (e.g., a closure, lid, cap, cover, top, end, can end, sanitary end, "pop-top", "pull top", convenience end, convenience lid, pull-off end, easy open end, "EZO" end, etc.). The container end may be any element that allows the container to be sealed such that the container is capable of maintaining a vacuum. The container end may be made of metals, such as steel or aluminum, metal foil, plastics, composites, or combinations of these materials. The container is typically a food container suitable for use with a thermal process. It should be understood that the phrase "food" used to describe various embodiments of this disclosure may refer to dry food, moist food, powder, liquid, or any other drinkable or edible material, regardless of nutritional value. It should be further understood that the container may be formed from any material, including metals, various plastics, and glass.

Figure 1:
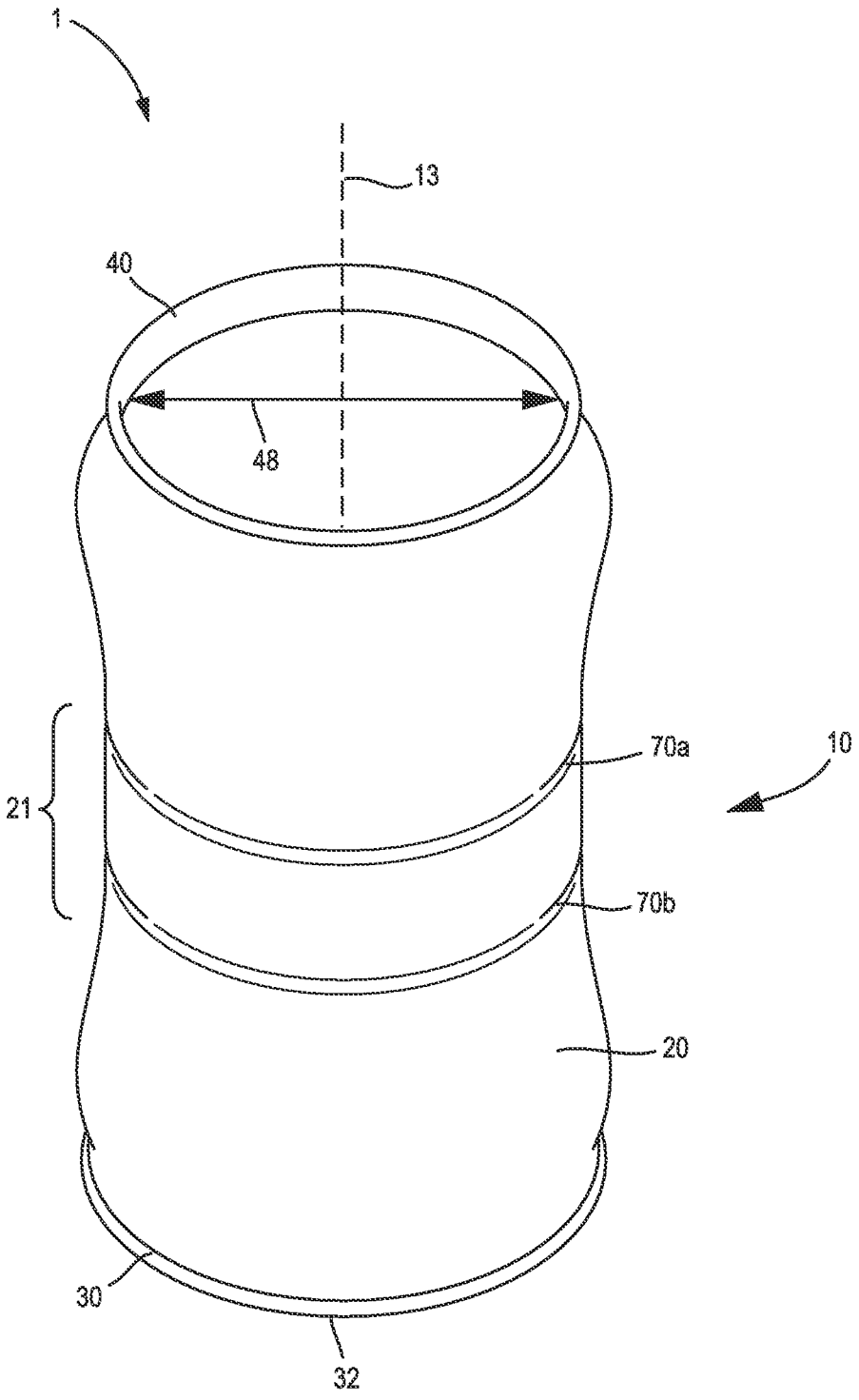
FIG. 1 shows a perspective view of a container having protective features according to an exemplary embodiment.

Referring to FIG. 1, a perspective view of a container 1 is shown, according to an exemplary embodiment. Container 1 includes a body 10 having a sidewall 20 and a bottom end wall 32. Body 10 is shown as generally cylindrical (i.e., the container walls or piece forming sidewall 20 are curvilinear). Body 10 is generally a cylinder having a circular cross section. More specifically, body 10 is generally a right cylinder wherein vertical axis 13 forms a right angle with bottom end wall 32. According to various other embodiments, body 10 may take any number of other container shapes as may be desirable for different applications or aesthetic qualities. For example, body 10 may be formed as a prism having one or more angles that create a horizontal polygonal cross section such as a rectangular cross section. In another embodiment, container 1 may be formed with an elliptical horizontal cross section. Container 1 may be sized to store about twenty-six ounces of liquid contents or combination of liquid and solid contents, or may be sized differently (e.g., less than twenty-six ounces, more than twenty-six ounces, twelve ounces, sixteen ounces, thirty two ounces, etc.).

Figure 2:
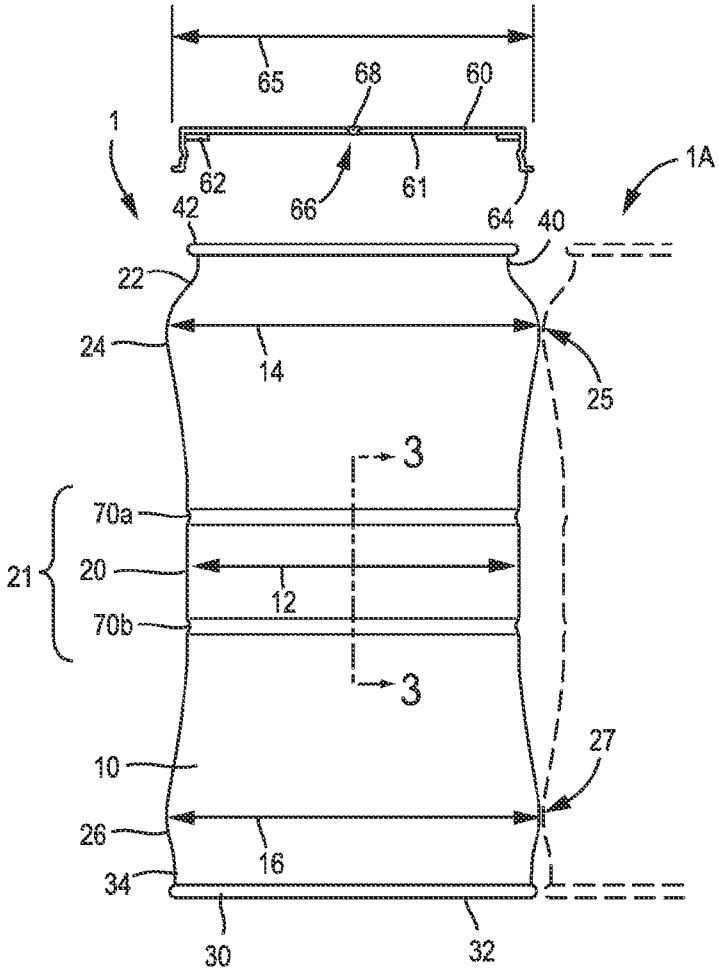
FIG. 2 shows a side view of a container having protective features according to an exemplary embodiment, and a cross-sectional view of a container closure proximal to the container.

Referring to FIG. 2, a side view of container 1 is shown, including body 10 having a vertical axis 13 and a center portion 21. Container 1 has a principal width, shown as principal diameter 12 in the cylindrical embodiment of FIG. 2. In an exemplary twenty-six ounce embodiment, principal diameter 12 is about 3.01 inches, and the height of body 10 is about 6.08 inches. In other embodiments, both the principal diameter and body height may be greater or lesser, and may vary according to the volumetric size of the container.

Body 10 is shown having a neck 40 integrally formed from the material of sidewall 20. Neck 40 may extend upward from a tapered transition 22 along the vertical axis of container body 10. The cross-sectional shape of neck 40 may substantially match the cross-sectional shape of the container end to be coupled to neck 40. In addition, the width, shape, and height of neck 40 may be sized to match the width, shape, and depth of a container end with which neck 40 will be used. Referring to FIG. 2, a container end, shown as closure 60, has a maximum container end width, shown as maximum closure diameter 65.

A rim or lip, shown as neck edge 42, may be curled or rounded to provide a suitable sealing surface (e.g., uniform and having some substantial diameter relative to the gauge of the container walls). Neck edge 42 may also be curled or rounded to provide a suitable surface for mouth contact or drinking. Neck edge 42 may curl to the inside or outside of neck 40. The exterior width of the neck and structures of the neck may be appropriately sized to allow a closure to function properly. Neck 40 and neck edge 42 define a neck opening 48 having a maximum opening width. In an exemplary twenty-six ounce embodiment, neck opening 48 is a circular opening having a maximum opening width or diameter of about 2.89 inches. In other embodiments, the diameter of neck opening 48 may be about 83 percent of first protective feature diameter 14. In alternative embodiments, neck opening 48 may have a diameter that is more than 83 percent of first protective feature diameter 14 (i.e., 90 percent, 95 percent, 99 percent), or less than 83 percent of first protective feature diameter 14 (i.e., 80 percent, 75 percent, 70 percent, or less).

Referring further to FIG. 2, the top of body 10 and sidewall 20 angle inward to create a tapered transition 22. In a typical embodiment, tapered transition 22 is a frusto-conical shoulder area. According to other various exemplary embodiments, where body 10 is provided with a polygonal cross section, tapered transition 22 may include a transition from the polygonal cross section of body 10 to a circular neck edge 42 and neck opening 48. In alternative embodiments where body 10 is provided with a polygonal cross section, tapered transition 22 need not include a transition from the polygonal cross section of body 10 to a circular neck edge 42, and neck edge 42 may thereby define a similarly polygonal neck opening 48.

According to an exemplary embodiment, tapered transition 22 is angled around thirty degrees from the vertical axis 13 of body 10. According to various other embodiments, tapered transition 22 is angled more or less than thirty degrees from vertical. According to an exemplary embodiment, tapered transition 22 is angled so that the diameter of neck opening 48 is about 83 percent of principal diameter 12 of body 10. Tapered transition 22 may also be provided with additional curvature to improve the visual aesthetics and/or structural stability of container 1. The curvature may create an aesthetically pleasing container top, provide a user with increased leverage for opening the top, and/or prevent the container top and closure from experiencing some amount of the unavoidable contact that containers typically have with adjacent containers or other structures during manufacture, shipping, and/or use.

Referring still further to FIG. 2, body 10 is further provided with a center portion 21. In an exemplary embodiment, center portion 21 is a cylindrical portion having a diameter equal to principal diameter 12 having vertical sidewalls. In this embodiment, the center portion has a substantially circular horizontal cross section. In an exemplary twenty-six ounce embodiment, center portion 21 has a height of about 1.25 inches. In an alternative embodiment, center portion 21 is smoothly concave such that the diameter at the midpoint of center portion 21 is a minimum diameter, and the container body diameter increases in the direction of first and second protective features 24 and 26.

Center portion 21 may optionally be provided with one or more beads 70, shown as beads 70*a* and 70*b*. In an exemplary embodiment, center portion 21 is provided with two beads 70*a* and 70*b*, wherein bead 70*a* is positioned near the top of cylindrical center portion 21, and bead 70*b* is positioned near the bottom of cylindrical center portion 21. However, one or more beads 70 may be placed at other locations on center portion 21, or within the curved portions of sidewall 20 comprising the protective features described in greater detail below. For example, in the embodiments shown in FIG. 5 and FIG. 6, a third bead 70*c* is located in center portion 21. Beads 70 provide a contour that strengthens center portion 21, thereby increasing resistance to deformation of center portion 21 caused by the pressure differential between the internal vacuum and the external atmospheric pressure. Beads 70 may further be configured to provide a contour to facilitate the grasping of container 1 by a user.

Figure 3:
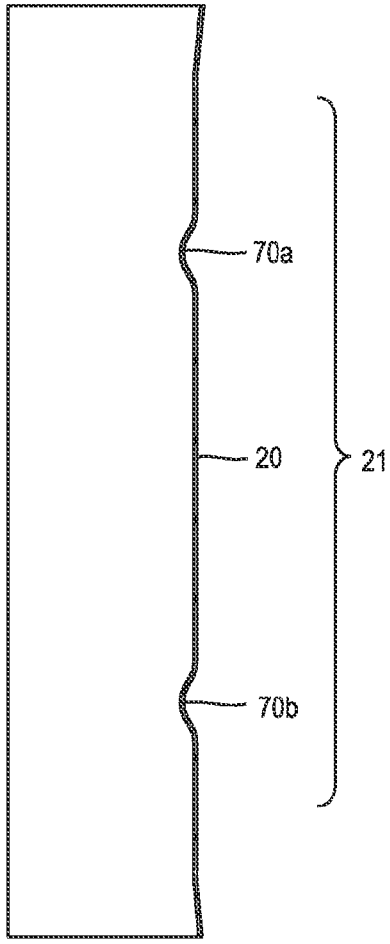
FIG. 3 shows a cross-sectional view of a portion of the container of FIG. 2 taken along line 3-3.

As shown best in FIG. 3 according to one exemplary embodiment, beads 70 are provided with a smoothly curved cross sectional profile concaving radially inward. In other embodiments, beads 70 may have other cross sectional profiles, such as a sinusoidal profile, a triangular profile, or a sawtooth profile. In an exemplary embodiment, beads 70 have a depth of about 0.03 inches, a radius of approximately 0.075 inches, and form a fillet with sidewall 20 with a radius of approximately 0.065 in. In alternate embodiments, beads 70 may have a depth of about 0.02 inches or less, or about 0.04 inches or more. In still another embodiment, beads 70 may extend radially outward from cylindrical center portion 21.

According to one exemplary embodiment, as shown in FIGS. 1-3, body 10 includes two beads 70. Beads 70 are generally located symmetrically along the length of center portion 21. In an exemplary twenty-six ounce embodiment, beads 70 may be spaced about 1.02 inches apart. Applicants have found that this embodiment sufficiently strengthens center portion 21 to resist deformation caused by the pressure differential between the internal vacuum and the external atmospheric pressure. Applicants have found that this embodiment resists deformation when subjected to a vacuum of at least 22 in Hg. However, beads 70 may be provided at the transitions from center portion 21 to the first and second protective features, or beads 70 may be located on the protective features. As shown in the exemplary embodiments of FIGS. 5 and 6, a third bead 70*c* may be provided equidistant between beads 70*a* and 70*b*. In still other exemplary embodiments, more or fewer beads may be provided and may be otherwise spaced.

Referring yet further to FIG. 2, body 10 is provided with a first feature, shown as first protective feature 24. First protective feature 24 may be any structure extending from container 1 such that the maximum width of sidewall 20 at first protective feature 24, shown as a first diameter 14, is greater than principal diameter 12. In the exemplary embodiment of FIG. 2, first protective feature 24 smoothly extends sidewall 20 radially outward relative to center portion 21 such that sidewall 20 at first protective feature 24 has a substantially circular horizontal cross section. In an exemplary embodiment, first protective feature 24 reaches a local maximum diameter at a first contact point 25. Contact between container 1 and one or more adjacent containers, shown as container 1A, is thereby limited to contact point 25. In an alternative embodiment, first protective feature 24 may include a substantially vertical portion having a constant first diameter 14 that is greater than principal diameter 12, defining a first vertical contact surface. In an exemplary embodiment, first diameter 14 is about 15 percent greater than principal diameter 12 at first contact point 25. In an exemplary twenty-six ounce embodiment, first diameter 14 is about 3.46 inches. In other embodiments, first diameter 14 may be greater than principal diameter 12 by less than 15 percent (e.g., 2 percent, 5 percent, 10 percent, 12 percent), or by more than 15 percent greater than principal diameter 12 (e.g., 18 percent, 20 percent, 25 percent, or more).

Body 10 may also be provided with at least a second feature, shown as second protective feature 26. Second protective feature 26 may be any structure extending from container 1 such that the maximum width of sidewall 20 at second protective feature 26, shown as second diameter 16, is greater than principal diameter 12. In the exemplary embodiment of FIG. 2, second protective feature 26 smoothly extends sidewall 20 radially outward relative to center portion 21 such that sidewall 20 at second protective feature 26 has a substantially circular horizontal cross section. In an exemplary embodiment, second protective feature 26 reaches a local maximum diameter at a second contact point 27. In an exemplary embodiment, second diameter 16 is equal to first diameter 14. Contact between container 1 and one or more adjacent containers 1A is thereby limited to contact points 25 and 27. In an alternative embodiment, second protective feature 26 may include a substantially vertical portion having a constant second diameter 16 that is greater than principal diameter 12, defining a second vertical contact surface.

As shown in FIG. 2, the portion of container body 10 between the maximum diameter of first protective feature 24 and the maximum diameter of second protective feature 26 is vertically symmetrical, wherein the plane of symmetry is located at the midpoint of center portion 21 and perpendicular to vertical axis 13. In addition, the portions of sidewall 20 between center portion 21 and first protective feature 24 and second protective feature 26 are shown as continuous, inwardly curved portions having a width that tapers to join center portion 21. As shown in FIG. 2, the portions of sidewall 20 between center portion 21 and first protective feature 24 and second protective feature 26 curve in toward center axis 13 such that the sidewall 20 has a concave profile.

In an exemplary embodiment, second diameter 16 is about 15 percent greater than principal diameter 12. In an exemplary twenty-six ounce embodiment, second diameter 16 is about 3.46 inches. In other embodiments, second diameter 16 may be greater than principal diameter 12 by less than 15 percent (e.g., 2 percent, 5 percent, 10 percent, 12 percent), or by more than 15 percent greater than principal diameter 12 (e.g., 18 percent, 20 percent, 25 percent, or more). In an alternative embodiment, second diameter 16 is greater than principal diameter 12 and also different than first diameter 14.

First and second protective features 24 and 26 provide limited contact surfaces between two or more adjacent containers at first contact point 25 and second contact point 27. The protective features strengthen the sidewalls of the container against side impacts, thereby improving panel resistance to denting or other compressive deformation. Any type of label or design (not shown) may be disposed on central portion 21 of sidewall 20. A label or design disposed on center portion 21 is thereby protected from abrasive contact with adjacent containers 1A during manufacturing, processing, shipping, and/or display. In an exemplary embodiment, the container may be provided with a plastic shrink sleeve. A plastic shrink sleeve may optionally extend to partially cover closure 60 and incorporate tamper evident features. In yet another embodiment, the material of container body 10 may further be painted, coated, or provided with a decorative finish.

Referring still further to FIG. 2, body 10 is provided with a second tapered transition 34 connecting second protective feature 26 to bottom seal structure 30. In an exemplary embodiment, bottom seal structure 30 has a diameter of about 3.31 inches. In a typical embodiment, second tapered transition 34 is angled from the vertical axis at an angle of about 12 degrees. However, second tapered transition 34 may be provided angles greater or lesser than 12 degrees. In an alternative embodiment, second tapered transition 34 may be approximately vertical. If second tapered transition 34 is approximately vertical, the diameter of bottom seal structure 30 is approximately equal to second diameter 16.

According to an exemplary embodiment, container 1 is formed of metal about 0.0095 inches thick and is primarily made of tin-plated steel. According to various other exemplary embodiments, container 1 is formed from steel having a working gauge range from about 0.006 inches thick to about 0.012 inches thick, or other available working ranges. According to various other alternative embodiments, container 1 may be formed of aluminum, tin free steel, and/or another material that may be used to form food or beverage containers. The material of container 1 may also be more or less thick along certain structures or locations of sidewall 20. For example, the material of sidewall 20 may be thicker at first protective feature 24 and second protective feature 26 than the remaining portions of sidewall 20, thereby strengthening container 1 at points of contact 25 and 27 with adjacent containers. In another example, in center portion 21, the material may be more thin than material closer to the top end or bottom end.

Referring yet still further to FIG. 2, container 1 is shown having a bottom seal structure 30 at the lower end of container body 10. Bottom seal structure may couple and seal a bottom end wall 32 to container body 10. According to an exemplary embodiment, bottom seal structure 30 is a double seam including folds of metal joining a bottom lip or flange of sidewall 20 and bottom end wall 32 so that a hermetic seal is created. In an alternative embodiment, sidewalls 20 and bottom end wall 32 are contiguously formed or molded from a single piece of material. According to an exemplary embodiment, bottom end wall 32 is provided with a concave recession adapted to releasably receive a closure 60. Nesting of closure 60 into bottom end wall 32 thereby facilitates the orderly vertical stacking of several containers.

According to the exemplary embodiment of FIG. 2, a container end, shown as closure 60, has a maximum container end width, shown as maximum closure diameter 65. Closure 60 is shown proximate to neck 40 in FIG. 2 in a cross sectional view to reveal several internal features, according to an exemplary embodiment. Closure 60 is shown having a closure underside or interior surface 61. Sealing material, shown as closure gasket 62, may be disposed on closure underside 61 to contact and seal against neck edge 42. According to an exemplary embodiment, closure 60 has a vacuum safety button that requires a 5 inch Hg vacuum to verify the seal is intact. According to various other exemplary embodiments, the closure may include other tamper evidencing features or no tamper evidencing features.

Closure 60 is adapted to cover and seal neck opening 48. Neck opening 48 is sized such that the maximum diameter 65 of closure 60 is less than first protective feature diameter 14, thereby protecting closure 60 from impact with adjacent containers 1A. According to an exemplary twenty-six ounce embodiment, closure 60 may have a maximum diameter of 78 millimeters. According to one alternative embodiment, closure 60 is a 67 mm diameter closure. However, closure 60 may be any size appropriate to fit differently sized neck openings, as required by variations in the neck opening and/or volumetric size of the container. In alternative embodiments, closure maximum diameter 65 is 88 percent of first protective feature diameter 14. However, closure maximum diameter 65 may be greater than 88 percent of first protective feature diameter 14 (i.e., 90 percent, 95 percent, 98 percent) or lesser than 88 percent of first protective feature diameter 14 (i.e., 85 percent, 80 percent, 70 percent), provided that external closure diameter 65 is less than first protective feature diameter 14.

According to an exemplary embodiment, closure 60 is a press-on, vacuum seal closure (e.g., a Dot Top closure). A press-on, vacuum seal closure refers to a closure that is initially coupled to a body by a press-on (i.e., placed on) movement, and is substantially retained on the body by the pressure differential between the exterior and interior of the container. A vacuum seal closure is later removed by breaking the vacuum seal formed during the filling and closing process.

Figure 4:
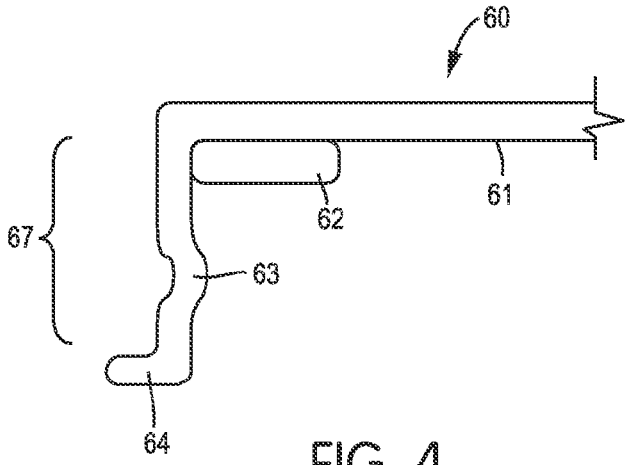
FIG. 4 shows a detail cross-sectional view of a portion of the container closure of FIG. 2.

Referring to FIG. 4, closure 60 may be provided with a closure skirt 67 and a closure bottom rim 64. Closure skirt 67 is a substantially vertical wall portion extending below the circumference of closure 60. The lower edge of skirt 67 terminates in a closure bottom rim 64, which may be a rolled edge, a rounded edge, or a bead of a similar or different material than skirt 67. Closure skirt 67 may be further provided with one or more lugs 63. Lugs 63 are indentations or dimples in the circumference of skirt 67 that releasably engage the outer diameter of neck edge 42, thereby mechanically coupling closure 60 to neck edge 42. After the initial vacuum seal is broken by a user, lugs 63 permit the user to reattach closure 60 by popping closure 60 over neck edge 42. A single lug 63 may extend partially or entirely around the circumference of skirt 67, or two or more discreet lugs 63 may be disposed about the circumference of skirt 67. According to an exemplary embodiment, closure skirt 67 is provided with three lugs 63, each lug having a circumferential length of about 0.3 to 0.5 inches.

According to other embodiments, closure skirt 67 and bottom rim 64 are smooth such that bottom rim portion does not have any lugs, threads, or other structures to mechanically couple closure 60 onto neck 40 and/or neck edge 42. According to various alternative embodiments, closure 60 may be a plastic closure or another closure other than metal. According to other alternative embodiments, closure 60 may be a press-on, twist-off type metal closure (i.e., push-on/twist-off cap, etc.). A press-on, twist-off closure refers to a closure that is initially coupled to a body by a press-on (i.e., push-on) movement, but then is later removed or reattached to threads configured on neck 40 by a twisting motion.

Referring again to FIG. 2, according to an exemplary embodiment, the metal of closure 60 is between about 0.006 inches and about 0.012 inches thick. Closure underside 61 may be coated with a gasket or gasket material 62. According to an exemplary embodiment, gasket 62 is a plastisol material or compound applied to closure underside 61. Materials other than plastisol may serve as the gasket. Plastisol may provide sufficient resistance to acids of food products that may come into contact with the plastisol, may permit hot-fill processes to produce a vacuum, and may withstand a heat-based commercial sterilization or cooking process. A sufficient amount of the gasket material coats closure underside 61. The plastisol compound need not contain preformed indents or receiving structures. Rather, steam or another application of heat is used to soften the plastisol material prior to pressing closure 60 onto neck 40 and neck edge 42 of the container. The difference between the diameter of the gasket material and the structure of neck edge 42 cause the softened gasket 62 to move and flow around neck edge 42 so that the interface between neck edge 42 and closure underside 61 forms a hermetic seal. Following cooling of the plastisol, the plastisol stiffens or hardens to create a resilient foam that maintains the hermetic seal without any additional mechanical restraint.

According to an exemplary embodiment, gasket 62 specifically comprises a plastisol compound that may be characterized as a "508 compound" or similar material. Gasket 62 may be a liquid applied gasket or any other suitable gasket material. Material comprising gasket 62 may alternatively or additionally be applied to neck edge 42 prior to coupling with closure 60.

The user of various exemplary embodiments of a container described throughout this application may open the container by applying a lifting force to a point on the circumference of closure bottom rim 64. Closure 60 will thereby be directed upward relative to body 10, breaking the vacuum seal and releasing closure 60 from body 10. In an alternative embodiments, a pressure release hole 66 and plug 68 (e.g., a Dot Top) may optionally be incorporated into closure 60 to provide an alternate method of breaking the vacuum seal and releasing closure 60 from body 10.

Figure 5:
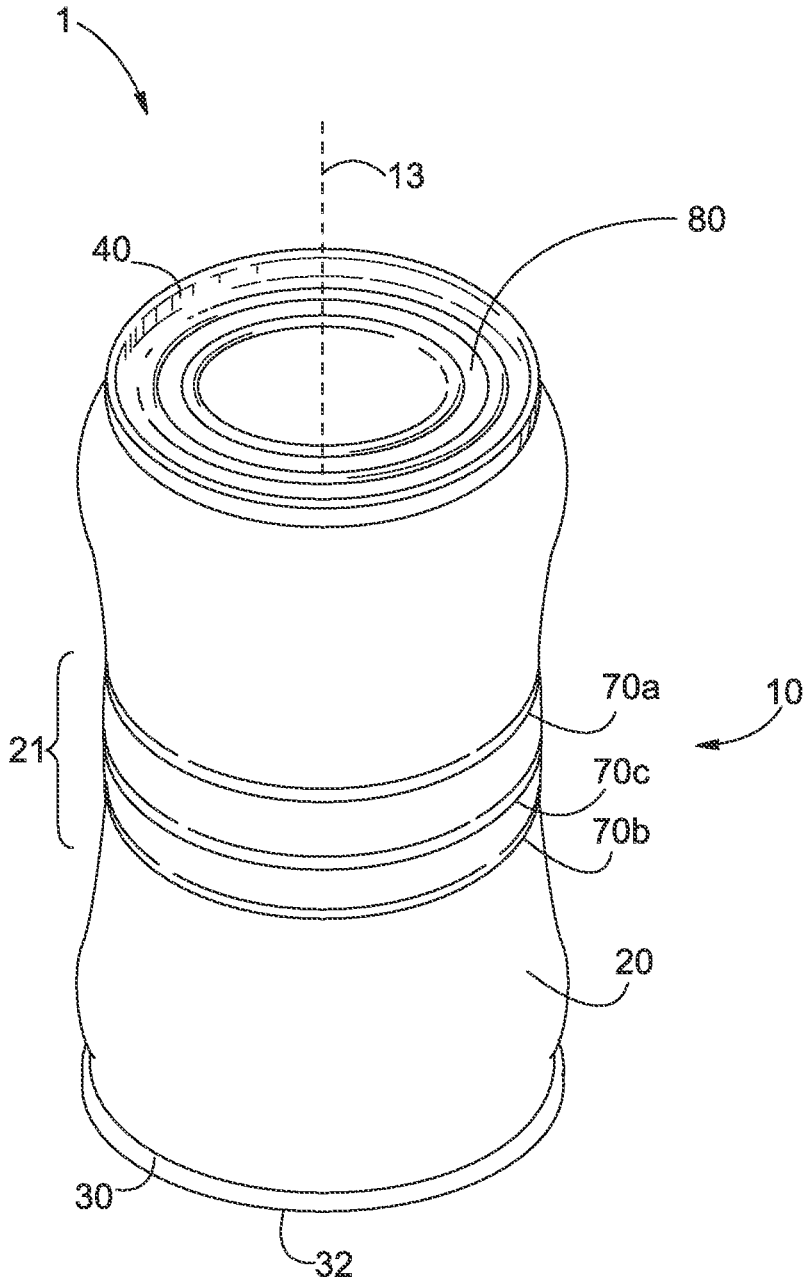
FIG. 5 shows a prospective view of a container having protective features and a sanitary end according to an exemplary embodiment.
Figure 6:
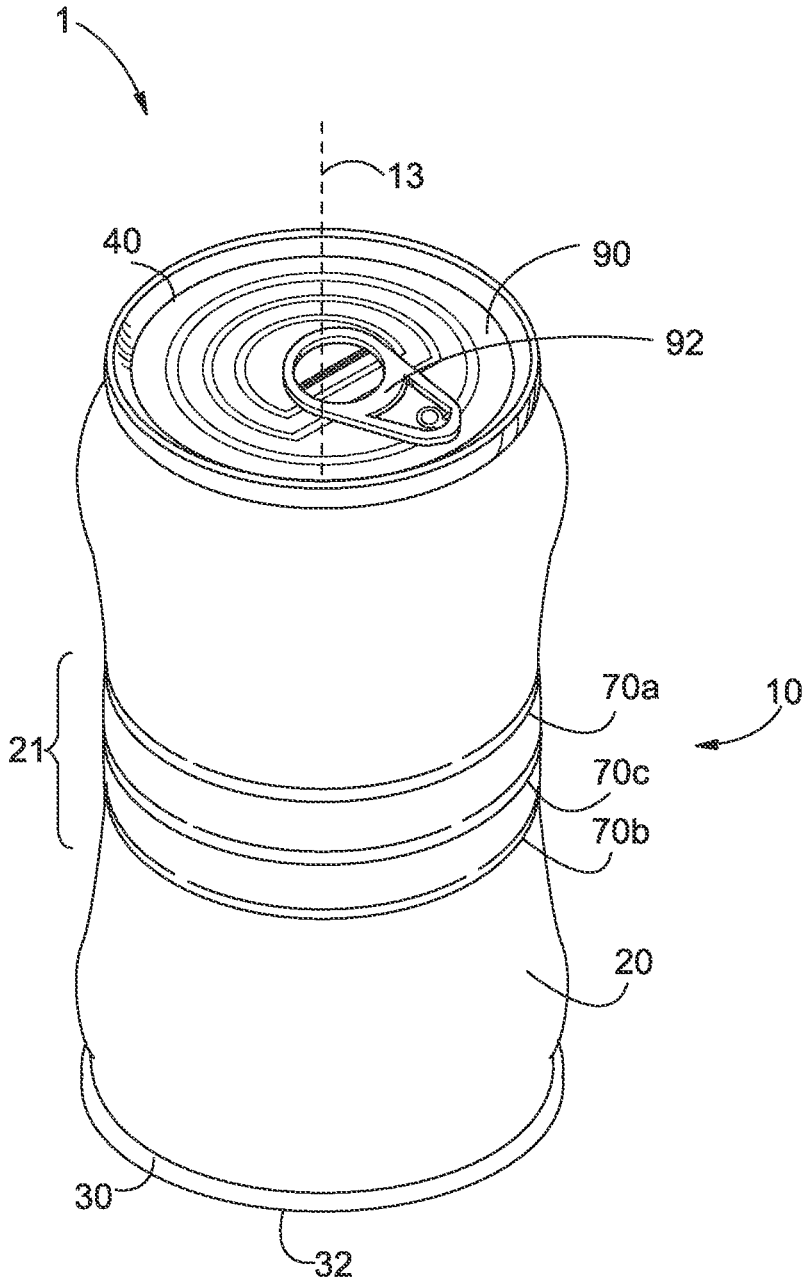
FIG. 6 shows a prospective view of a container having protective features and a pull-top end according to an exemplary embodiment.

As shown in the exemplary embodiments of FIGS. 2, 5 and 6, container 1 may be sealed with a wide variety of container ends. Referring to FIG. 5, a container end, shown as a sanitary can end 80, is coupled to neck 40. Sanitary can end 80 is coupled to neck 40 by folding together material from the edge of sanitary can end 80 with material from neck 40 and then crimping or pressing the folded material to form a seam (e.g., a double seam). Sanitary can end 80 may be coupled to neck 40 in any other way that hermetically seals container 1. Sanitary can end 80 may be removed using a tool such as a can-opener to access the contents of container 1.

Referring to FIG. 6, a container end, shown as pull off end 90, is coupled to neck 40. Pull off end 90 includes a tab or ring 92 that allows pull off end 90 to be removed without a tool such as a can-opener. Pull off end 90 may be coupled to neck 40 by the formation of a seam (e.g. a double seam) or any other way that hermetically seals container 1. Pull off end 90 may also include structures (e.g., a score, thin connecting metal, etc.) to aid in the removal of pull off end 90. In another exemplary embodiment, pull off end 90 may be an "EZO" convenience end, sold under the trademark "Quick Top" by Silgan Containers Corp.

In an alternative exemplary embodiment, pull off end 90 may include a thin sheet or membrane attached to a flange extending from the inner surface of container 10. The flange may be perpendicular to the inner surface of container 10. In other exemplary embodiments, the flange may extend from the inner surface of container 10 such that the flange forms an angle greater than or less than 90 degrees with the inner surface of container 10. According to this embodiment, the pull off end 90 may be attached to the lip or flange with an adhesive or other suitable material such that pull off end 90 seals container 10. The pull off end 90 may be made of metal foil, plastic, or other suitable material.

Container 1 may be formed by stretching, rolling, welding, molding, or any other forming process. During the manufacturing process, the container may also be washed and coated as required for workability, cleanliness of the container, and longevity of the container surfaces when subjected to container contents, liquids, and/or air.

According to an exemplary embodiment, the container may be a three-piece can wherein a flat blank or sheet of material is shaped or bent until a first side and a second side of the shaped sheet may be welded together. According to an exemplary embodiment, container 10 may be formed using a "Stretch Machine 2" made by Indústria de Máquinas Moreno Ltda. According to various alternative embodiments, although the container includes a closure at the top end, and a bottom end part at the bottom end, the container embodies a 2-piece can in that one continuous blank of material forms the container body, neck, and protective features and a vertical seam or weld line does not run down the side wall of the container.

According to an exemplary embodiment, the container may include a liner (e.g., an insert, coating, lining, etc.) positioned within the interior chamber of the container. The liner may protect the material of the container from degradation that may be caused by the contents of the container. In an exemplary embodiment, the liner may be a coating that may be applied via spraying or any other suitable method. According to an exemplary embodiment, the interior surface container material is pre-coated before the forming process. According to various other exemplary embodiments, the interior and/or exterior of the container are coated with a preservative organic coating after the container is formed or substantially formed. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, and/or other suitable preservative spray. The coating, for example, may be a spray epoxy such as PPG Z12215L, sold by PPG Industries, Inc. According to other embodiments, the coating may be a coating such as sold by Valspar Coatings (e.g., coating number 6256-069, etc.).

According to various other embodiments, a container kit may be provided utilizing various containers and closures described herein. A container kit may comprise a container body, blanks used to form a container body, a closure, and/or gasket material.

Processing may include steps of controllably ramping up temperature, cooking, and then controllably bringing temperature down or dropping temperature. As the container and the food inside the container are heated, the food is commercially sterilized (made shelf-stable) so that the food does not bacteriologically spoil.

According to an exemplary embodiment, a container as described herein may be used with a hot fill process. In a hot fill process, hot food is added to a container and a closure 60 is coupled to body 10 at neck edge 42. Gasket 62 may be pre-warmed to soften the gasket material, or it may be warmed by contact with a hot container. When closure 60 is coupled to body 10, a seal is formed by the gasket material deforming and flowing around neck edge 42. As the gasket cools, it hardens and forms around neck edge 42 and resembles a resilient foam. As the container begins cooling, a negative pressure relationship or a vacuum develops on the container interior. A strong vacuum (e.g., 19 in Hg to 22 in Hg) is thereby formed between closure 60 and container body 10 that holds the closure onto the body and maintains the hermetic seal. According to various other exemplary embodiments, a weaker or stronger vacuum sufficient to maintain lid to container integrity may be created and maintained. Control of product characteristics (e.g. air content, temperature), closure conditions, overall container temperature, container headspace, steam supplementation, and thermal process conditions may be used to yield a weaker or stronger vacuum.

The container disclosed herein may be further subjected to a thermal process. A thermal process may generally be characterized as a process of subjecting the filled and closed container to a cooking or sterilization process within a closed or open vessel containing a heating medium having different heat, time, and pressure variables sufficient to substantially sterilize the interior and contents of the food container. In an exemplary embodiment, the thermal processes is an overpressure thermal retort process, where pressure outside the container is substantially matched or slightly exceeded relative to the pressure that builds on the inside of the container due to heating a sealed container. Overpressure thermal retort processes may generally include inserting a filled and closed container (or group of containers) into a retort vessel that heats the container via steam, water, steam/air, or a combination of steam and water or steam and air and provides external overpressure to prevent container deformation, breakage, or separation of closure 60 from body 10 due to pressure build-up inside the container.

During a thermal retort process, the container and the food inside the container will be brought to a temperature of about at least 200 degrees Fahrenheit. According to various exemplary embodiments, a thermal retort process may include bringing the container to a temperature of between 220 degrees Fahrenheit and 275 degrees Fahrenheit. According to yet other embodiments, a thermal retort process includes bringing the container to a temperature of at least 240 degrees Fahrenheit. According to an exemplary embodiment, the container and closure should be able to withstand a thermal retort process of about 250 degrees Fahrenheit with about 32 pounds per square inch of total pressure (15 psi process pressure plus 17 psi overriding pressure) for a period of about 45 minutes and a 3 pounds per square inch differential between overriding pressure and internal pressure.

The specifications of the thermal retort process will vary depending on the food being cooked, heating medium, the machinery (e.g., retort vessel) being used, the amount of agitation used with the heat, and any number of other variables. It may be desirable to cook different types of food to certain different minimum temperatures for certain different minimum amounts of time to ensure commercial sterilization or "shelf stability". A container and closure of the present application should be able to withstand a variety of typical temperature, time, and pressure levels such that the container may be considered suitable for use with a thermal retort process for a wide variety of foodstuffs, including, for example, adult nutritional drinks, to those skilled in the art of food sterilization using a retort process.

In another embodiment, a container as described herein may be used with a non-thermal process. In a non-thermal process, food is added to a container at an ambient temperature, such as 65 degrees Fahrenheit. The container and contents are subjected to a strong vacuum (e.g., 19 in Hg to 22 in Hg), and a closure is attached to the container. Gasket 62 may be pre-warmed to soften the gasket material. When closure 60 is coupled to body 10, a seal is formed by the gasket material deforming and flowing around neck edge 42. As the gasket cools, it hardens and forms around neck edge 42 and resembles a resilient foam. After the seal is formed, the pressure outside the container may be returned to a standard atmospheric pressure. The closure and seal preserve the vacuum inside the container, thereby retaining the closure against the body until the vacuum seal is broken.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the container as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. Other substitutions, modifications, changes and omissions may be made in the design, operating conditions and arrangement of the exemplary embodiments without departing from the scope of the present application.

What is claimed is:

1. A metal food container comprising:

a metal can end wall;

a metal sidewall having a central axis perpendicular to the metal can end wall, the metal sidewall comprising:

a central cylindrical portion parallel to the central axis, the central cylindrical portion having a first diameter;

an open first end;

a second end coupled to the metal can end wall by a hermetic double seam;

a first sidewall feature positioned between the central cylindrical portion and the open first end, the first sidewall feature having a second diameter greater than the first diameter;

a second sidewall feature positioned between the central cylindrical portion and the second end, the second sidewall feature having a third diameter greater than the first diameter;

a first sidewall segment extending from the central cylindrical portion to the first sidewall feature providing a radially outwardly extending transition from the first diameter to the second diameter;

a second sidewall segment extending from the central cylindrical portion to the second sidewall feature providing a radially outwardly extending transition from the first diameter to the third diameter; and first and second circumferential beads positioned within the central cylindrical portion;

wherein a height of the first sidewall segment is greater than a height of the central cylindrical portion;

wherein a height of the second sidewall segment is greater than the height of the central cylindrical portion;

wherein a diameter of the metal sidewall at the open first end is less than both the second diameter and the third diameter, wherein a diameter of the metal can end wall is less than both the second diameter and the third diameter, wherein the metal sidewall includes a transition section that extends radially inwardly from the second sidewall feature toward the metal can end wall.

2. The metal food container of claim 1 wherein the first and second circumferential beads extend radially inward relative to the first diameter, wherein a height between the first sidewall feature and the open first end is less than both the height of the first sidewall segment and the height of the central cylindrical portion, wherein a height between the second sidewall feature and the second end is less than both the height of the second sidewall segment and the height of the central cylindrical portion, wherein the height of the central cylindrical portion is at most 0.26 times a height measured between the first sidewall feature and the second sidewall feature.

3. The metal food container of claim 2 further comprising a second metal end wall sealed to the open first end of the metal sidewall, wherein the first and second metal end walls maintain an internal vacuum such that there is a pressure differential between the inside of the sealed metal food container and the atmospheric pressure, and wherein the first and second circumferential beads strengthen the metal food container against the internal vacuum.

4. The metal food container of claim 1 further comprising a third circumferential bead that extends radially inward relative to the first diameter and is located between the first and second circumferential beads, wherein the height of the first sidewall segment is equal to the height of the second sidewall segment.

5. A food container comprising:

a first end and a second end;

a total height as measured from the first end to the second end;

a first metal end wall located at the second end;

a metal sidewall extending from the first end to the second end, the metal sidewall comprising:

a first circumferential bead having an upper edge;

a second circumferential bead having a lower edge;

a center portion extending from the upper edge of the first circumferential bead to the lower edge of the second circumferential bead, the center portion having a center diameter and a center height;

a top transition portion extending radially outward from the upper edge of the first circumferential bead to a first maximum diameter greater than the center diameter;

a bottom transition portion extending radially outward from the lower edge of the second circumferential bead to a second maximum diameter greater than the center diameter;

wherein the top transition portion has a top portion height greater than the center height and the bottom transition portion has a bottom portion height greater than the center height; and wherein the center height is at most approximately 0.21 times the total height;

wherein a diameter of the first end is less than both the first maximum diameter and the second maximum diameter, wherein a diameter of the first metal end wall is less than both the first maximum diameter and the second maximum diameter, wherein the metal sidewall includes a third transition portion that extends radially inwardly from the second maximum diameter toward the first metal end wall.

6. The food container of claim 5 wherein the first maximum diameter is substantially equal to the second maximum diameter.

7. The food container of claim 5 wherein the upper edge of the first circumferential bead is a first distance from the first end of the food container and the lower edge of the second circumferential bead is a second distance from the second end of the food container and the first distance is substantially equal to the second distance.

8. The food container of claim 6 wherein above the center diameter is a first half of the food container and below the center diameter is a second half of the food container and the first and second halves of the food container are vertically symmetrical.

9. The food container of claim 5 wherein the first maximum diameter is not located at the first end of the food container.

* * * * *